US005911256A

United States Patent [19]

Tsai

[11] Patent Number: 5,911,256

[45] Date of Patent: Jun. 15, 1999

[54] BRUSH HAVING A BRISTLED HEAD CAPABLE OF BEING POWERED BY WATER TO SWIVEL

[76] Inventor: James Tsai, 103, Ta-Ming 1 Rd., Tung Pao Tsun, Tan Tzu Hsiang, Taichung Hsien, Taiwan

[21] Appl. No.: 09/005,778

[22] Filed: Jan. 12, 1998

[51] Int. Cl.[6] ..... A46B 11/06

[52] U.S. Cl. ..... 15/22.1; 15/24; 15/29

[58] Field of Search ..... 15/22.1, 23, 24, 15/28, 29

[56] References Cited

U.S. PATENT DOCUMENTS

| | | | |
|---|---|---|---|
| 2,678,457 | 5/1954 | Demo et al. | 15/29 |
| 4,378,804 | 4/1983 | Cortese | 15/29 |
| 4,532,666 | 8/1985 | Smyth | 15/29 |

*Primary Examiner*—Terrence R. Till
*Attorney, Agent, or Firm*—Browdy and Neimark

[57] ABSTRACT

A water-powered brush is composed of a handle, a bristled head, and a flexible tubular body located between the handle and the bristled head. The bristled head is provided with an impeller and a centrifugal member capable of actuating the bristled head to move back and forth on the surface of an object at such time when the impeller is driven by water.

9 Claims, 3 Drawing Sheets

BRUSH HAVING A BRISTLED HEAD CAPABLE OF BEING POWERED BY WATER TO SWIVEL

FIELD OF THE INVENTION

The present invention relates generally to a brush, and more particularly to a water-powered brush.

BACKGROUND OF THE INVENTION

The conventional brushes have a bristled head incapable of swiveling automatically while it is at work. As a result, the conventional brushes do not make the cleaning jobs easier for the cleaners at large.

SUMMARY OF THE INVENTION

The primary objective of the present invention is to provide a brush with a water-powered head capable of swiveling at such time when the brush is at work.

In keeping with the principle of the present invention, the foregoing objective of the present invention is attained by a brush consisting of a handle and a bristled head. The bristled head is provided with an impeller and a centrifugal member. As the impeller is driven by water to rotate, the bristled head is actuated by the centrifugal member to swivel.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
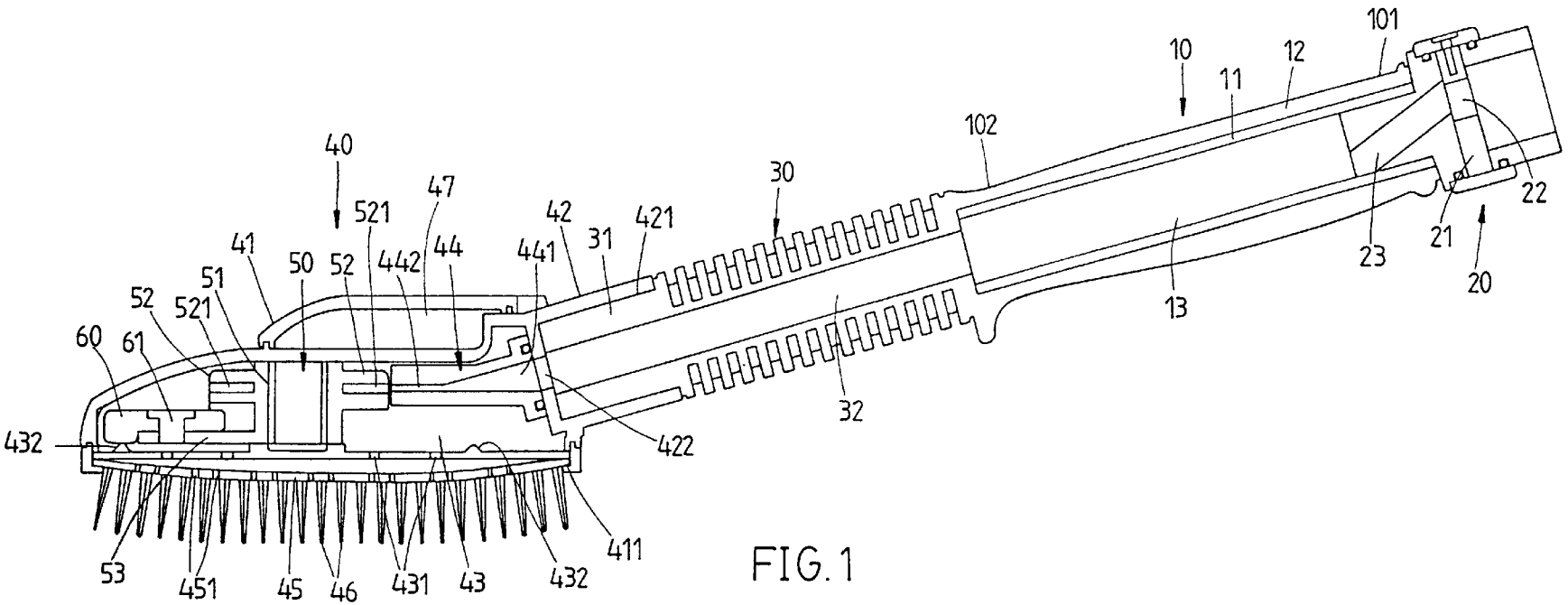
FIG. 1 shows a side sectional view of the present invention.

As shown in FIGS. 1–4, a brush embodied in the present invention is composed of component parts, which are described hereinafter.

A handle 10 is made up of a rigid inner tube 11 and a soft outer tube 12 which is fitted over the inner tube 11. The handle 10 is provided with a water duct 13 extending from a head end 101 to a tail end 102 of the handle 10.

A water injection control valve member 20 is housed in the head end 101 of the handle 10 such that the outer end of the valve member 20 is connected with a water-supplying hose. The water is allowed to enter the water duct 13 when a rotary disk 21 is rotated such that an eccentric hole 22 of the rotary disk 21 is aligned with a water inlet 23.

A flexible tubular body 30 has a rugged outer surface and is fastened at one end thereof with the tail end 102 of the handle 10. The tubular body 30 and the outer tube 12 are made integrally of a rubber material. The tubular body 30 has a connection portion 31 located at another end thereof and provided therein with a channel 32 in communication with the water duct 13.

A bristled head 40 has a housing 41 and a tubular neck 42 extending from the housing 41 and having a connection hole

421 which is engaged with the connection portion 31 of the tubular body 30. The tubular neck 42 is provided with an insertion hole 421 having in the bottom end thereof a through hole 422 smaller in diameter than the insertion hole 421 so as to enable the channel 32 of the tubular body 30 to be in communication with a receiving cell 43 of the interior of the housing 41. The receiving cell 43 is provided with a pressure tube 44, which has a water inlet 441 connected with the through hole 422 and in communication with an ejection port 442 via which the water is discharged. The receiving cell 43 is provided in the bottom thereof with a plurality of water draining holes 431 in communication with the outside of the housing 41. The housing 41 is provided in the periphery of the bottom thereof with a circular slot 411 and a circular body 45 retained in the circular slot 411. The circular body 45 has a plurality of water discharging holes 451 and bristles 46 attached thereto.

Figure 2:
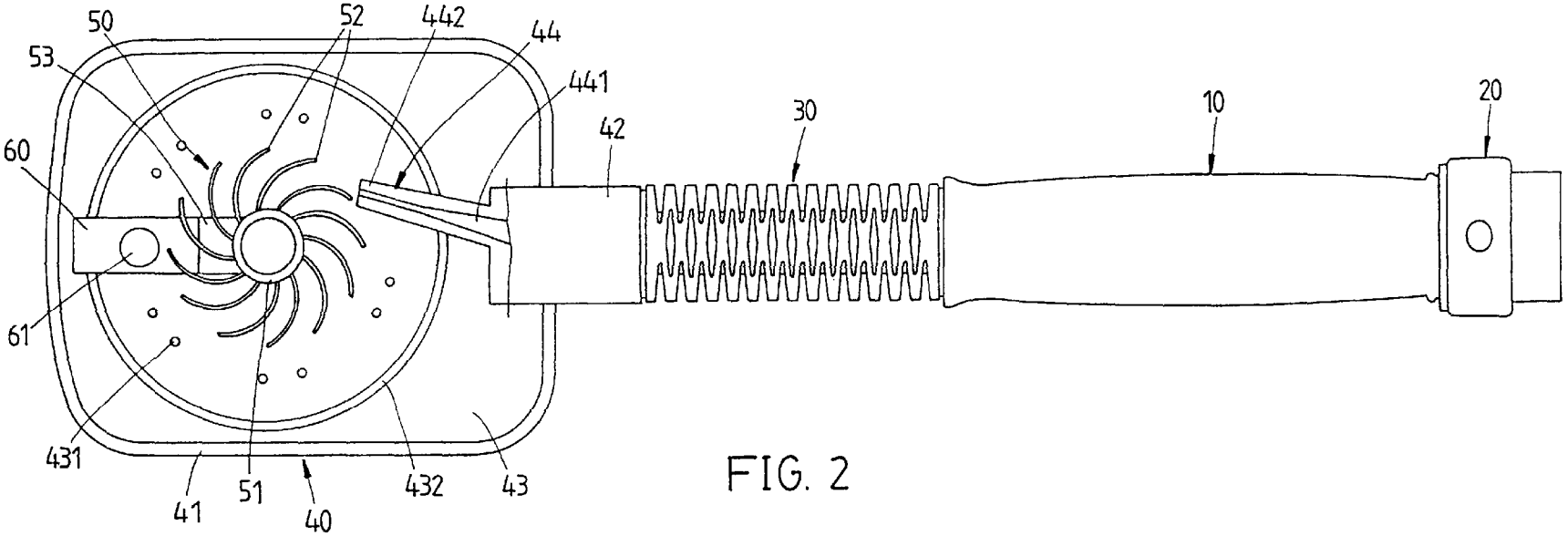
FIG. 2 shows a top sectional view of the present invention.

An impeller 50 is rotationally mounted in the receiving cell 43 of the bristled head 40 and is composed of a shaft 51 and a plurality of arcuate blades 52 mounted on the shaft 51, as shown in FIG. 2, such that the concave sides of the blades 52 face the ejection port 442 of the pressure tube 44.

A centrifugal member 60 is mounted by means of a fastening bolt 61 on a seat plate 53 extending from the bottom end of the shaft 51 for bringing about a centrifugal force at the time when the impeller 50 is at work. A portion of the centrifugal member 60 is supported by a protruded ring 432 of the receiving cell 43, so that the weight of the centrifugal member 60 does not cause the impeller 50 to turn aside.

In operation, the water injection control valve member 20 of the handle 10 is first connected with a water supply before rotating the rotary disk 21 to allow the water to enter the water duct 13 of the handle 10, the water is then guided to drive the blades 52 of the impeller 50 via the channel 32 of the flexible tubular body 30, the through hole 422, the water inlet 441 of the pressure tube 44, the ejection port 442, and the receiving cell 43 of the bristled head 40. The blades 52 are provided respectively and correspondingly with a slot 521 for enhancing the driving effect of the water. As the impeller is rotated, a centrifugal force is generated to actuate the bristled head 40 to swing in view of the fact that the bristled head 40 is fastened with one end of the tubular body 30, and that the handle 10 is fastened with another end of the tubular body 30, and further that the handle 10 is held securely by the user. The direction in which the bristled head 40 swings is perpendicular to the axial direction of the impeller 50. As a result, the bristles 46 are capable of brushing back and forth on a planar surface. After the water has propelled the impeller 50, the water will not spill all over the place in view of the obstruction of the wall of the receiving cell 43. The water is flushed out of the water discharging holes 451 via the water draining holes 431 to clean the surface of an object in conjunction with the bristles 46.

Figure 3:
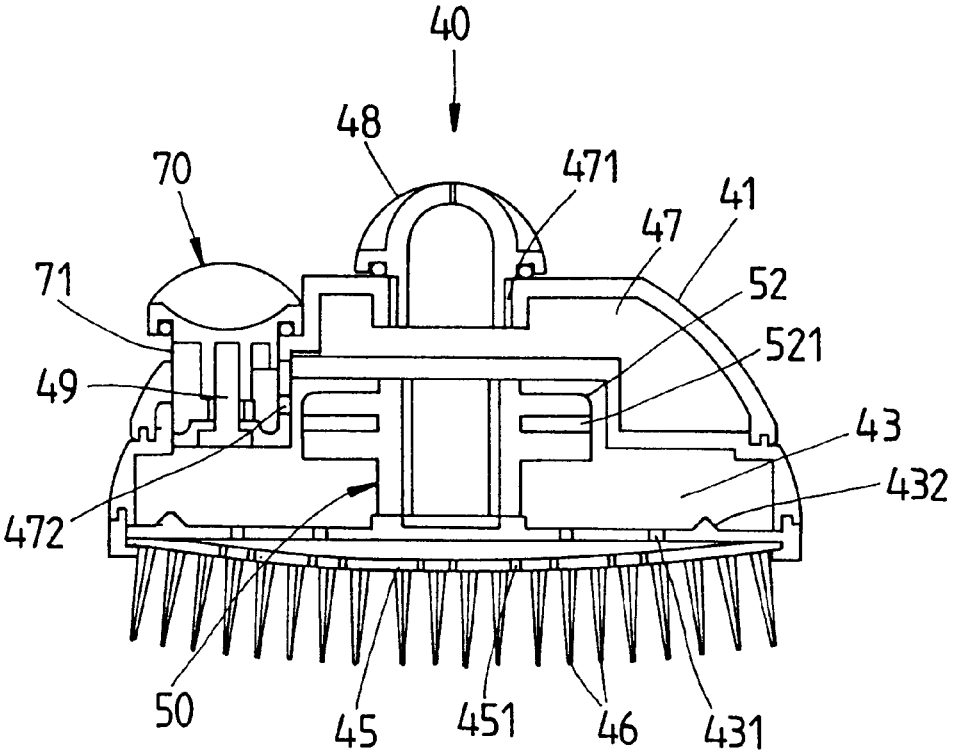
FIG. 3 shows a cross sectional view of the present invention.
Figure 4:
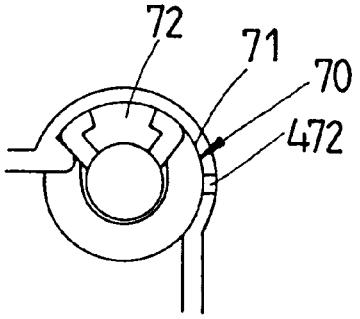
FIG. 4 shows a schematic view of a connection control valve member of the present invention.

The housing 41 of the bristled head 40 of the present invention is further provided with a cleansing agent cell 47 located over the receiving cell 43 for containing the liquid detergent. The cleansing agent cell 47 is provided with an injection port 471 having a cap 48 which is movably attached thereto, as illustrated in FIG. 3. The housing 41 is further provided with a connection control valve member 70 mounted on a shaft 49 which is fastened pivotally under the cleansing agent cell 47. The top end of the control valve member 70 is jutted out of the housing 41 such that the top end can be rotated. When the connection valve member 70 is turned, the liquid detergent contained in the cleansing agent cell 47 is allowed to flow into the receiving cell 43 via a connection hole 472 such that the liquid detergent is mixed with water in the receiving cell 43. The liquid detergent can be prevented from flowing into the receiving cell 43 from the cleansing agent cell 47 by rotating the connection valve member 70 to cause a sectoral plug 72 of a cylindrical body 71 of the connection valve member 70 to obstruct the connection hole 472.

The rotary disk 21 of the water injection control valve member 20 can be so turned that the eccentric hole 22 is not aligned with the water inlet 23, thereby resulting in the interruption of the water supply. However, the bristled head remains capable of swiveling.

The embodiment of the present invention described above is to be regarded in all respects as being merely illustrative and not restrictive. Accordingly, the present invention may be embodied in other specific forms without deviating from the spirit thereof. For example, the present invention may be provided with two cleansing agent cells for containing the cleansing agents different in nature and purpose. In addition, the introduction of water into the brush of the present invention may take place via a water inlet located at the bristled head instead of the handle. The present invention is therefore to be limited only by the scopes of the following appended claims.

What is claimed is:

1. A water-powered brush comprising:

a handle;

a flexible tubular body fastened at one end thereof with said handle;

a bristled head fastened with another end of said flexible tubular body and provided with bristles attached thereto, said bristled head further provided with a water inlet and an ejection port in communication with said water inlet;

an impeller having a shaft fastened rotationally with said bristled head, said impeller further having a plurality of blades; and a centrifugal member fastened with said impeller such that said centrifugal member is capable of bringing about a centrifugal force for actuating said bristled head to move back and forth at such time when said blades of said impeller are driven by water which is introduced into said bristled head from a water supply.

2. The brush as defined in claim 1, wherein said bristled head is provided with a receiving cell having a plurality of water draining holes; and wherein said impeller is mounted in said receiving cell of said bristled head.

3. The brush as defined in claim 2, wherein said bristled head is provided with at least one cleansing agent cell located over said receiving cell for containing a cleansing agent, said cleansing agent cell provided with an injection port and a connection control valve member for regulating the state of communication between said cleansing agent cell and said receiving cell.

4. The brush as defined in claim 3, wherein said connection control valve member has a rotatable cylindrical body provided with a plug capable of obstructing a connection hole of said cleansing agent cell to interrupt communication between said cleansing agent cell and said receiving cell.

5. The brush as defined in claim 1, wherein said handle has a water duct engageable at one end thereof with a water supply; and wherein said flexible tubular body has a channel extending in the direction of a longitudinal axis of said flexible tubular body and communicating with said water duct of said handle and said water inlet of said bristled head.

6. The brush as defined in claim 5, wherein said handle is provided with a water injection control valve member engageable with a water supply hose for controlling the state of connection of said hose and said water duct of said handle.

7. The brush as defined in claim 6, wherein said water injection control valve member is provided with a water inlet in communication with said water duct of said handle, and a rotary disk located at a junction of said hose and said water inlet and provided with an eccentric hole capable of being relocated to be in alignment with said water inlet of said water injection control valve member.

8. The brush as defined in claim 1, wherein said bristled head is provided with a water flow duct tapering from said water inlet thereof toward said ejection port thereof.

9. The brush as defined in claim 1, wherein said blades of said impeller are of an arcuate shape; and wherein said ejection port faces concave sides of said blades of said impeller.

* * * * *